US008195071B2

(12) United States Patent
Hatakeyama et al.

(10) Patent No.: US 8,195,071 B2
(45) **Date of Patent: *Jun. 5, 2012**

(54) DEVELOPING DEVICE

(75) Inventors: Takashi Hatakeyama, Kanagawa (JP); Minoru Yoshida, Tokyo (JP); Takao Izumi, Kanagawa (JP); Hiroshi Murata, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/899,690

(22) Filed: Oct. 7, 2010

(65) Prior Publication Data

US 2011/0020038 A1 Jan. 27, 2011

Related U.S. Application Data

(63) Continuation of application No. 12/326,531, filed on Dec. 2, 2008, now Pat. No. 7,831,181.

(60) Provisional application No. 60/992,941, filed on Dec. 6, 2007.

(51) Int. Cl.
*G03G 15/095* (2006.01)
*G03G 15/08* (2006.01)

(52) U.S. Cl. ..... 399/264; 399/254

(58) Field of Classification Search ..... 399/61, 399/62, 254, 256, 257, 264
See application file for complete search history.

(56) References Cited

U.S. PATENT DOCUMENTS

| | | | | |
|---|---|---|---|---|
| 4,963,929 | A | 10/1990 | Ueda et al. | |
| 6,343,200 | B1 | 1/2002 | Hatano et al. | |
| 6,587,661 | B1 | 7/2003 | Shimmura et al. | |
| 7,376,374 | B2 | 5/2008 | Adachi | |
| 7,536,138 | B2 | 5/2009 | Hirota | |
| 7,764,908 | B2 | 7/2010 | Hatakeyama et al. | |
| 7,831,181 | B2 * | 11/2010 | Hatakeyama et al. | 399/264 |
| 2006/0210318 | A1 | 9/2006 | Murata et al. | |

FOREIGN PATENT DOCUMENTS

| | | |
|---|---|---|
| JP | 2000-081787 | 3/2000 |
| JP | 2000-112238 | 4/2000 |

* cited by examiner

*Primary Examiner* — Sandra Brase
(74) *Attorney, Agent, or Firm* — Turocy & Watson, LLP

(57) ABSTRACT

In an embodiment, a reducing plate that dams up a part of a developer scraped up by a blade is provided. The reducing plate suppresses swell of the developer held up by a discharge mixer from fluctuating according to the rotation of the blade. Fluctuation in an excess developer discharged from a discharge port is suppressed and replace a deteriorated carrier in a development container with a new carrier little by little.

20 Claims, 9 Drawing Sheets

DEVELOPING DEVICE

CROSS-REFERENCE TO RELATED APPLICATION

This application is a Continuation of application Ser. No. 12/326,531 filed on Dec. 2, 2008, the entire contents of which are incorporated herein by reference.

This application is based upon and claims the benefit of priority from provisional U.S. Application 60/992,941 filed on Dec. 6, 2007, the entire contents of which are incorporated herein by reference.

TECHNICAL FIELD

The present invention relates to a developing device that performs development using a two-component developer including a toner and a carrier in an image forming apparatus of an electrophotographic system such as a copying machine or a printer.

BACKGROUND

As a developing device used in an image forming apparatus such as a copying machine or a printer, there is a device that performs development using a two-component developer. In the developing device that uses the two-component developer, a toner equivalent to an amount consumed by a development operation is supplied. However, in such a developing device, performance of a carrier falls and charging performance of the toner is deteriorated while the toner is supplied.

A system called trickle development system is provided in order to suppress the deterioration in the charging performance of the toner. The trickle development system is a system for supplying a new carrier (a concentrated toner) to a development container separately from the toner supplied to supplement the consumed amount. An excess developer that cannot be stored in the development container because of the supply of the carrier is discharged from a discharge port. In this way, the deteriorated carrier is replaced with the new carrier little by little.

As such a developing device of the trickle system, for example, JP-A-2000-81787 discloses a developing device that holds up a developer and then discharges the developer from a discharge port in which a developer scattering preventive member is arranged.

On the other hand, in the developing device of the trickle system, a device that detects toner density in a holdup position of a developer near a discharge port is provided. A certain amount of the developer needs to be accumulated in a detection position for a toner density sensor to measure magnetic permeability and detect toner density. However, when the surface of the toner density sensor is soiled, misdetection occurs. Therefore, there is a device that rotates a blade and sweeps the surface of the toner density sensor with the blade to remove the soil.

When the blade is rotated near the discharge port of such a device, the developer is likely to be further swelled by the blade in the holdup position of the developer. The developer is excessively discharged from the discharge port because of the further swell of the developer by the blade. Therefore, an amount of the discharge of the developer is not stabilized. This is likely to affect the feeding of the developer to a developing roller.

Therefore, even when toner density is detected by making use of the holdup of the developer for the discharge of the developer from the discharge port, the developer is stably discharged from the discharge port. As a result, there is a demand for the development of a developing device that can stabilize an amount of the developer in the development container and stably feed the developer to the developing roller.

SUMMARY

According to an aspect of the present invention, the discharge of a developer from a discharge port is stabilized. A satisfactory development characteristic is obtained and the improvement of an image quality of a toner image is realized by stabilizing an amount of the developer in a development container.

According to an embodiment, a development container that stores a developer including a toner and a carrier, a developing member that feeds the developer in the development container to an image bearing member, a developer supplying member that supplies the developer to the development container, an agitating and carrying member that agitates the developer and circulates and carries the developer in the development container, a developer discharging member that is formed in the development container and discharges a part of the developer, a swelling member that swells a surface of the developer in a position opposed to the developer discharging member and a reducing member that suppresses a swell of the developer.

DETAILED DESCRIPTION

Figure 1:
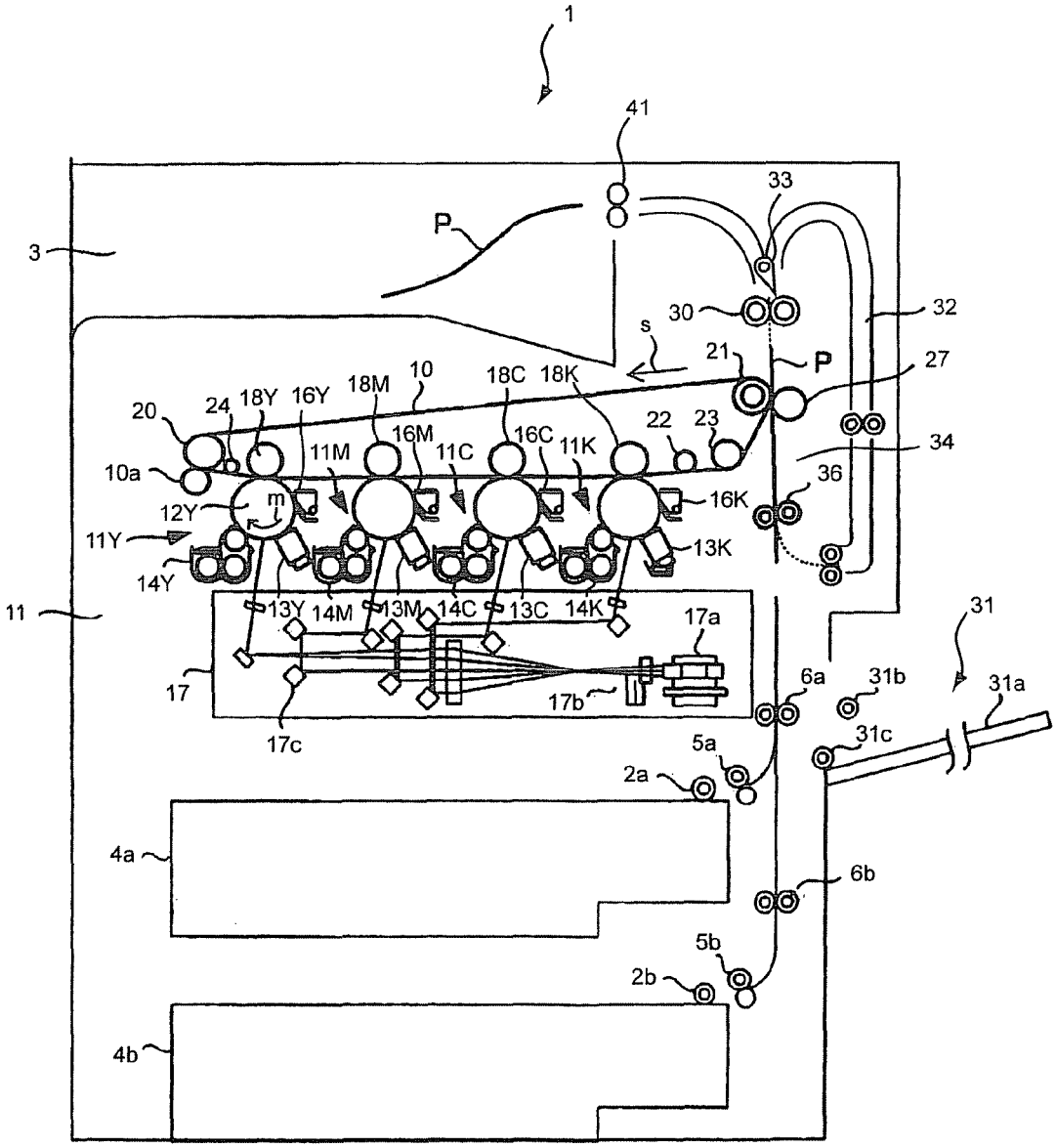
FIG. 1 is an overall structural diagram of an image forming apparatus according to a first embodiment of the present invention.

A first embodiment of the present invention is explained in detail below with reference to the accompanying drawings as an example. FIG. 1 is a schematic diagram of a color printer 1 as an image forming apparatus according to the first embodiment. The color printer 1 is a quadruple tandem color printer. The color printer 1 includes a paper discharging unit 3 in an upper part thereof.

The color printer 1 includes an image forming unit 11 on a lower side of an intermediate transfer belt 10. The image forming unit 11 includes four sets of process units 11Y, 11M, 11C, and 11K arranged in parallel along the intermediate transfer belt 10. The process units 11Y, 11M, 11C, and 11K form toner images of yellow (Y), magenta (M), cyan (C), and black (K), respectively.

Figure 2:
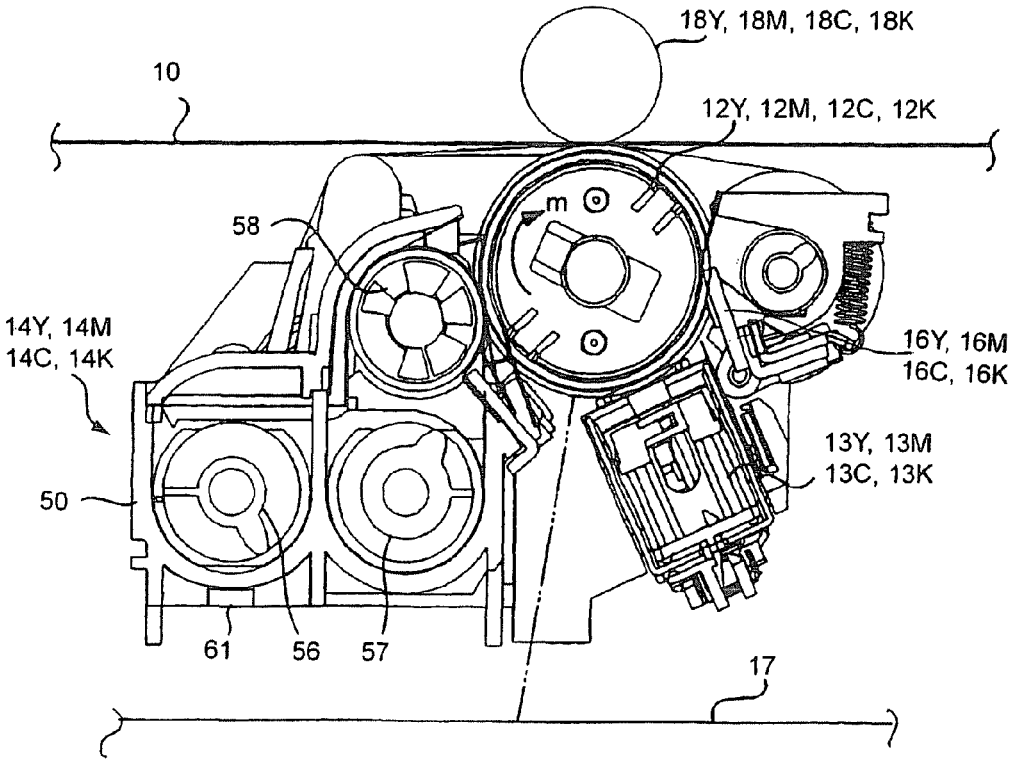
FIG. 2 is a schematic structural diagram of an image forming unit according to the first embodiment.

As shown in FIG. 2, the process units 11Y, 11M, 11C, and 11K respectively include photoconductive drums 12Y, 12M, 12C, and 12K as image bearing members. The photoconductive drums 12Y, 12M, 12C, and 12K rotate in an arrow "m" direction. Electrification chargers 13Y, 13M, 13C, and 13K, developing devices 14Y, 14M, 14C, and 14K, and photoconductive cleaners 16Y, 16M, 16C, and 16K are arranged around the photoconductive drums 12Y, 12M, 12C, and 12K, respectively, along the rotating direction.

Exposure lights emitted by a laser exposing device 17 are respectively irradiated on sections between the electrification chargers 13Y, 13M, 13C, and 13K and the developing devices 14Y, 14M, 14C, and 14K around the photoconductive drums 12Y, 12M, 12C, and 12K. The laser exposing device 17 scans laser beams emitted from semiconductor laser elements in the axial directions of the photoconductive drums 12. The laser exposing device 17 includes a polygon mirror 17*a*, a focusing lens system 17*b*, and a mirror 17*c*. Electrostatic latent images are formed on the photoconductive drums 12Y, 12M, 12C, and 12K by the laser exposing device 17. The electrification chargers 13Y, 13M, 13C, and 13K and the laser exposing device 17 configure a latent image forming member.

The developing devices 14Y, 14M, 14C, and 14K develop the electrostatic latent images on the photoconductive drums 12Y, 12M, 12C, and 12K, respectively. The developing devices 14Y, 14M, 14C, and 14K perform development using two-component developers including toners of yellow (Y), magenta (M), cyan (C), and black (K), which are developers, and carriers.

The intermediate transfer belt 10 is stretched and suspended by a backup roller 21, a driven roller 20, and first to third tension rollers 22 to 24 and rotates in an arrow "s" direction.

The intermediate transfer belt 10 is opposed to and set in contact with the photoconductive drums 12Y, 12M, 12C, and 12K. Primary transfer rollers 18Y, 18M, 18C, and 18K are respectively provided in positions of the intermediate transfer belt 10 opposed to the photoconductive drums 12Y, 12M, 12C, and 12K. The primary transfer rollers 18Y, 18M, 18C, and 18K primarily transfer toner images formed on the photoconductive drums 12Y, 12M, 12C, and 12K onto the intermediate transfer belt 10, respectively. The photoconductive cleaners 16Y, 16M, 16C, and 16K remove and collect residual toners on the photoconductive drums 12Y, 12M, 12C, and 12K, respectively, after the primary transfer.

A secondary transfer roller 27 is opposed to a secondary transfer section of the intermediate transfer belt 10 supported by the backup roller 21. In the secondary transfer section, predetermined secondary transfer bias is applied to the backup roller 21. When sheet paper P passes between the intermediate transfer belt 10 and the secondary transfer roller 27, the toner images on the intermediate transfer belt 10 are secondarily transferred onto the sheet paper P. The sheet paper P is fed from paper feeding cassettes 4*a* and 4*b* or a manual feed mechanism 31. After the secondary transfer is finished, the intermediate transfer belt 10 is cleaned by a belt cleaner 10*a*.

Pickup rollers 2*a* and 2*b*, separation rollers 5*a* and 5*b*, conveying rollers 6*a* and 6*b*, and a registration roller pair 36 are provided between the paper feeding cassettes 4*a* and 4*b* and the secondary transfer roller 27. A manual feed pickup roller 31*b* and a manual feed separation roller 31*c* are provided between a manual feed tray 31*a* of the manual feed mechanism 31 and the registration roller pair 36. A fixing device 30 is provided further downstream than the secondary transfer section along the direction of a vertical conveying path 34. The fixing device 30 fixes the toner images, which are transferred on the sheet paper P in the secondary transfer section, on the sheet paper P. A gate 33 that distributes the sheet paper P in the direction of a paper discharge roller 41 or the direction of a re-conveying unit 32 is provided downstream of the fixing device 30. The sheet paper P guided to the paper discharge roller 41 is discharged to a paper discharging unit 3. The sheet paper P guided to the re-conveying unit 32 is guided in the direction of the secondary transfer roller 27 again.

The developing devices 14Y, 14M, 14C, and 14K are explained in detail below. The developing devices 14Y, 14M, 14C, and 14K have the same structure. Therefore, components of the developing devices 14Y, 14M, 14C, and 14K are explained by using the same reference numerals and signs. As shown in FIG. 2, each of the developing devices 14Y, 14M, 14C, and 14K includes a case 50 as a development container, a developing roller 58 as a developing member, a first mixer 56 and a second mixer 57 as agitating and carrying members, and a toner density sensor 61 as a toner-density detecting member.

Figure 3:
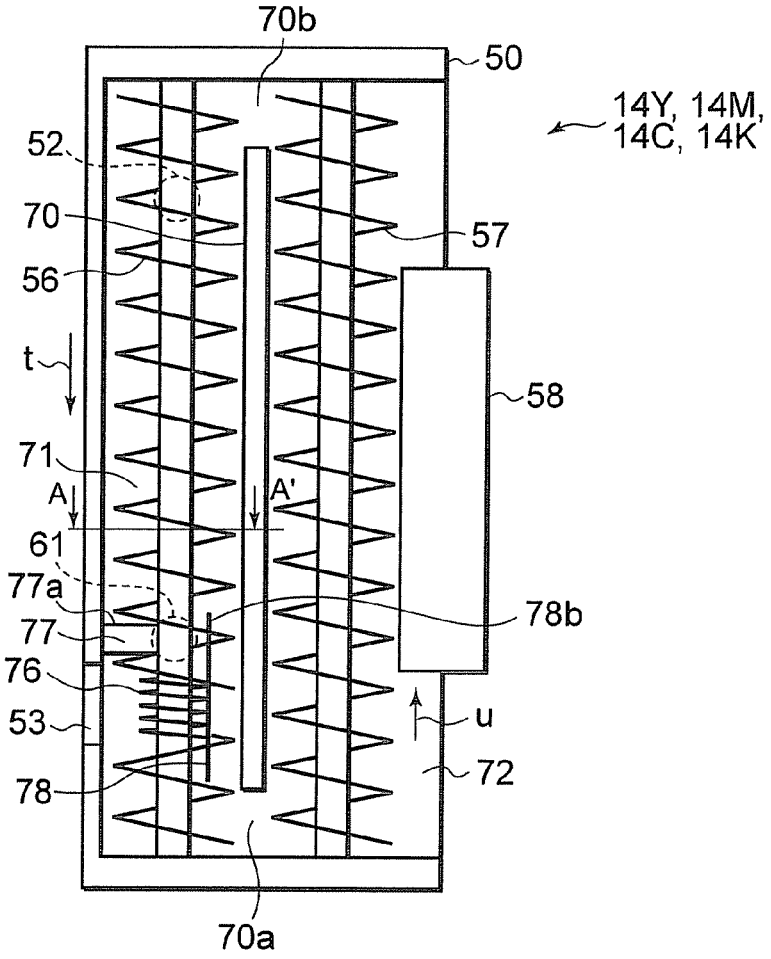
FIG. 3 is a schematic diagram for explaining a flow of a developer in a development container according to the first embodiment.
Figure 4:
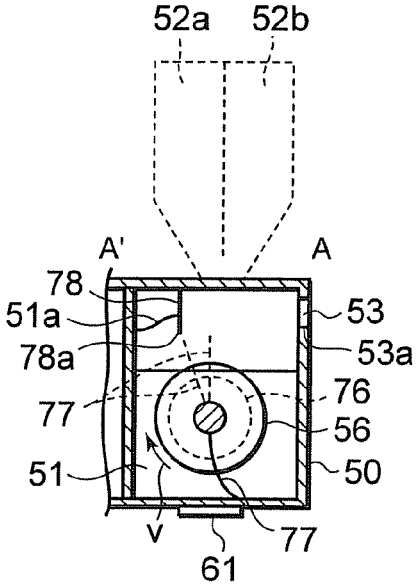
FIG. 4 is a schematic diagram viewed from an A-A' side in FIG. 3 for explaining the dam-up of the developer by a plate according to the first embodiment.
Figure 5:
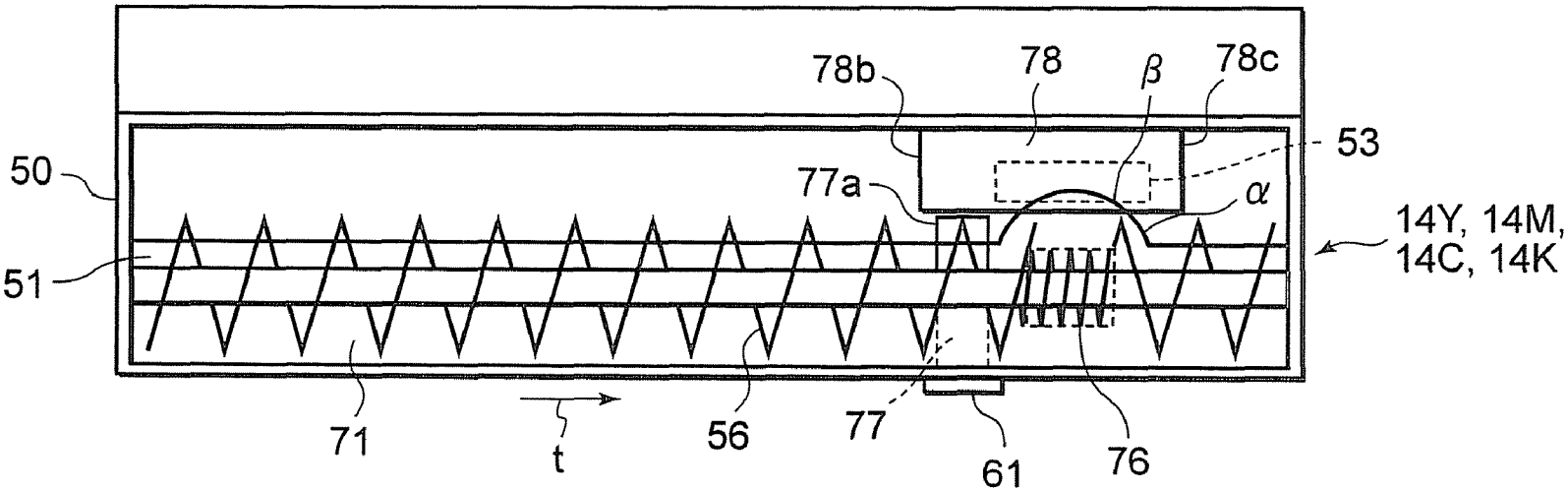
FIG. 5 is a schematic diagram for explaining the swell of the developer in the development container according to the first embodiment.

As shown in FIGS. 3 to 5, a supply port 52 for a developer 51 is formed in the case 50 that stores the developer 51. A toner equivalent to an amount consumed by development is supplied to the supply port 52 from a toner cartridge 52*a* that configures a developer supplying member. Anew carrier is also supplied to the supply port from a carrier cartridge 52*b* that configures the developer supplying unit. As the supply of the new carrier, only a carrier may be supplied. Alternatively, the new carrier may be supplied by supplying a two-component developer including a toner and a carrier. A deteriorated carrier is replaced with the new carrier little by little by supplying a predetermined amount of the new carrier while development operation is performed. Consequently, toner charging performance of the developer 51 in the case 50 is maintained uniform.

A discharge port 53 as a developer discharging member is formed in a side portion on a front side of the case 50. Since the volume of the developer in the case 50 is increased by the supply of the new carrier, an excess developer is discharged from the discharge port 53 and collected. Consequently, in the case 50, an amount of the developer 51 is maintained constant. At the same time, in the case 50, the deteriorated carrier is replaced with the new carrier little by little in the developer 51.

The developing roller 58 carries the developer 51 in the case 50 to a development position and feeds toners to electrostatic latent images formed on the photoconductive drums 12Y, 12M, 12C, and 12K, respectively. The inside of the case 50 is partitioned by a partition plate 70 along the axial direction of the photoconductive drums 12Y, 12M, 12C, and 12K. The inside of the case 50 is partitioned into a first agitation passage 71 and a second agitation passage 72 by the partition plate 70. In the first agitation passage 71, the new toner and the new carrier supplied from the developer supply port 52 and the developer 51 in the case 50 are agitated and carried in an arrow "t" direction by the first mixer 56. The developer 51 agitated and carried by the first mixer 56 is carried to the second agitation passage 72 through a first conducting section 70*a*. In the second agitation passage 72, the developer 51 is agitated and carried in an arrow "u" direction by the second mixer 57 and supplied to the developing roller 58. The developer 51 passing through the developing roller 58 is carried to the first agitation passage 71 through a second conducting section 70*b*. The developer 51 is circulated and carried in the case 50 by the first mixer 56 and the second mixer 57.

In the position of the discharge port 53, a discharge mixer 76 as a swelling member is formed in the first mixer 56. As shown in FIGS. 4 and 5, the discharge mixer 76 is coaxial with the first mixer 56. The discharge mixer 76 has a small diameter of vanes and a small pitch of the vanes compared with those of the first mixer 56. The discharge mixer 76 reduces a flow rate of the developer 51 circulated and carried in the case 50. When the flow rate of the developer 51 is reduced while the developer 51 is carried in the arrow "t" direction, as indicated by a solid line α in FIG. 5, the developer 51 is held up. The surface of the developer 51 is swelled high in a position opposed to the discharge port 53 and is formed in a mountain shape. The toner density sensor 61 is provided on a bottom surface of the case 50 in the first agitation passage 71. It is preferable that the toner density sensor 61 is arranged at a slight amount of the developer 51 is held and apart from the developer supply port 52. With such an arrangement, the toner density sensor 61 improves accuracy of measurement of toner density in the developer 51. As the toner density sensor 61, for example, a magnetic permeability sensor is used. When a fall in the toner density of the developer 51 in the case 50 is detected by the toner density sensor 61, the toner is supplied from the developer supply port 52 according to a result of the detection. In this way, the toner density of the developer 51 in the case 50 is maintained constant.

A blade 77 as a sweeping-out member is attached to the first mixer 56 above the toner density sensor 61. The blade 77 is made of, for example, urethane rubber and has elasticity. The blade 77 is rotated together with the first mixer 56 rotated in an arrow "v" direction. The blade 77 comes into slide contact with the surface of the toner density sensor 61 during rotation. In this way, the blade 77 sweeps out the toner on the surface of the toner density sensor 61 and removes the soil on the surface of the toner density sensor 61. The sweeping-out member does not have to have elasticity and may be made of ABS resin (copolymer synthetic resin of Acrylonitrile-Butadiene-Styrene) or the like in a tabular shape. However, it is preferable that the tabular sweeping-out member does not come into slide contact with the toner density sensor 61 and has a slight space of about 0.5 mm from the toner density sensor 61.

A flat reducing plate 78 as a reducing member is arranged on the opposite side of the discharge port 53 across the discharge mixer 76. The reducing plate 78 is arranged in a direction parallel to the arrow "t". The reducing plate 78 is supported by an upper surface of the case 50. A lower end 78*a* of the reducing plate 78 is set at height that is lower than that of a lower end 53*a* of the discharge port 53. And the lower end 78*a* of the reducing plate 78 prevents from coming into contact with the tip of the blade 77. A first side end 78*b* of the reducing plate 78 on the toner density sensor side extends further to an upstream side than an upstream side end 77*a* of the blade 77. A second side end 78*c* of the reducing plate 78 extends further to a downstream side than a crossing position β of the discharge port 53 and the tip of the swell of the developer (a tip position of the developer discharged from the discharge port 53). In other words, the reducing plate 78 is formed larger than the discharge port 53. The size of the reducing member is not limited. However, fluctuation in the developer discharged from the discharge port 53 by the blade 77 can be further suppressed by forming the reducing plate 78 larger than the discharge port 53. As the lower end of the reducing member is set further lower than the lower end 53*a* of the discharge port 53, the developer moved to the discharge port 53 side by the blade 77 can be more suppressed. However, the reducing member is formed such that the excess developer, which should be discharged from the discharge port 53 by the swelling mechanism, is not prevented.

Actions of the reducing plate 78 are explained below. In the case 50, a supply toner and a predetermined amount of a new carrier are supplied from the developer supply port 52 while development operation is performed. According to the rotation of the first mixer 56 and the second mixer 57, the developer 51 circulates in the arrow "t" direction and the arrow "u" direction in the case 50 together with the supply toner and the new carrier. A flow rate of the developer 51 is reduced in the position of the discharge mixer 76 of the first agitation passage 71 and the developer 51 is swelled on a front surface of the discharge port 53. When the height of the swell of the developer 51 reaches the discharge port 53, an excess developer is discharged from the discharge port 53. In this way, a deteriorated carrier in the case 50 is replaced with the new carrier little by little.

Figure 6:
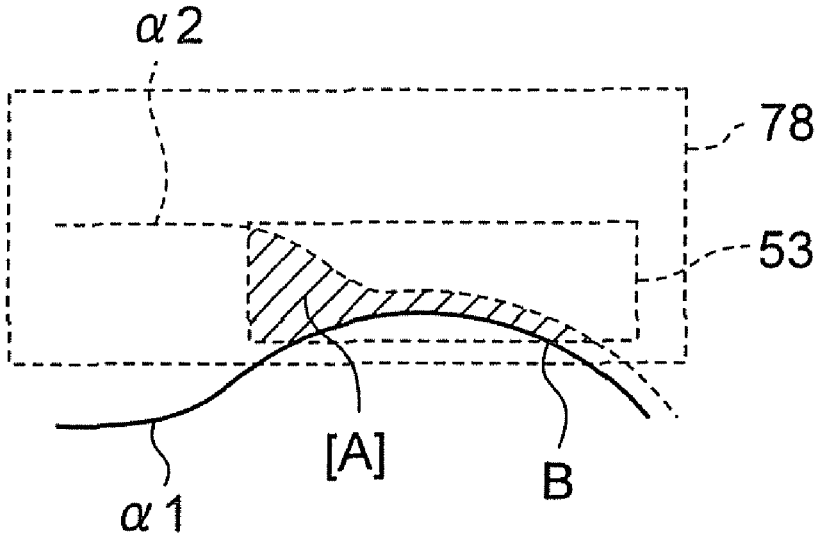
FIG. 6 is a schematic diagram for explaining fluctuation in the swell of the developer according to a rotating position of a blade at the time when the plate according to the first embodiment is not used.

On the other hand, the blade 77 attached to the first mixer 56 is rotated above the toner density sensor 61 on the upstream side from the discharge mixer 76. The height of the swell of the developer 51 by the discharge mixer 76 (the height of the solid line α in FIG. 5) is affected by the rotation of the blade 77. For example, when the blade 77 is present at the bottom, the height of the swell of the developer 51 is at the height of a solid line α1 in FIG. 6 without being affected by the blade 77. When the blade 77 moves to the top, the height of the swell of the developer 51 is affected by the developer scraped up by the blade 77. Assuming that the reducing plate 78 is not provided at this point, the height of the swell of the developer 51 substantially increases as indicated by a chain line α2 in FIG. 6. Therefore, an amount of the developer discharged from the discharge port 53 substantially fluctuates in a range [A] indicated by hatching in FIG. 6 between the time when the blade 77 is present at the bottom and at the time when the blade 77 is present at the top. Moreover, the blade 77 acts to push out the developer on the discharge port 53 side from the discharge port 53 with the rotation force thereof. Therefore, a large amount of the developer is discharged from the discharge port 53 more than necessary. An amount of the developer in the case 50 also fluctuates and affects development performance.

On the other hand, when the reducing plate 78 according to this embodiment is provided, the influence of the developer scraped up by the blade 77 is reduced. As shown in FIG. 4, a part of a developer 51*a* scraped up by the blade 77 is dammed up by the reducing plate 78. Even at a stage when the developer 51*a* starts to be scraped up, a part of the surface of the developer 51*a* in contact with the reducing plate 78 is dammed up from moving to the discharge port 53 side. Therefore, when the reducing plate 78 is provided, the height of the swell of the developer 51 at the time when the blade 77 moves to the top is suppressed as indicated by a chain line α3 in FIG. 7.

Figure 7:
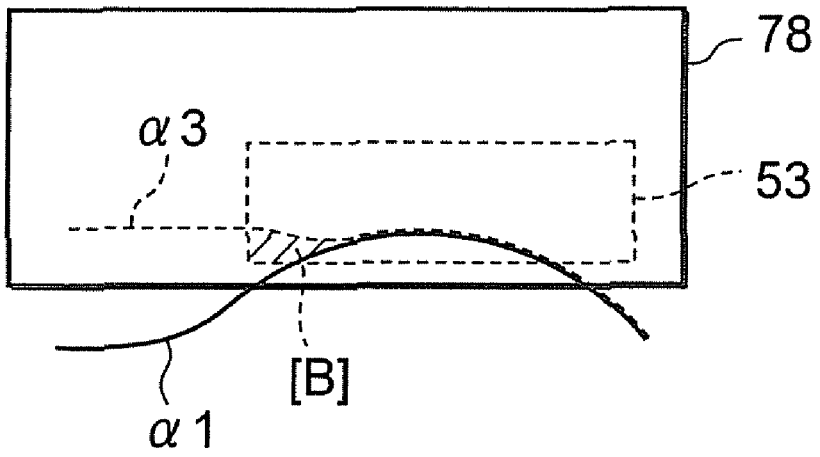
FIG. 7 is a schematic diagram for explaining fluctuation in the swell of the developer according to a rotating position of the blade according to the first embodiment.

Since a part of the developer 51 is dammed up by the reducing plate 78, the fluctuation in an amount of the developer discharged from the discharge port 53 between the time when the blade 77 is present at the top and the time when the blade 77 is present at the bottom can be suppressed in a range [B] as indicated by hatching in FIG. 7. Therefore, an amount of the developer pushed out by the rotation force of the blade 77 is also suppressed. As a result, an amount of the excess developer discharged from the discharge port 53 is stabilized. The developer 51 passing through the discharge mixer 76 is circulated and carried to the second agitation passage 72 through the first conducting section 70*a* of the partition plate 70. In the second agitation passage 72, the developer 51 is agitated and carried by the second mixer 57 and supplied to the developing roller 58. Since an amount of the excess developer discharged from the discharge port 53 is stabilized, the fluctuation in an amount of the developer in the case 50 is suppressed. Therefore, the feeding of the developer to the developing roller 58 is stabilized and satisfactory development performance can be obtained.

According to the first embodiment, a part of the developer scraped up by the blade 77 is dammed up by the reducing plate 78. This makes it possible to suppress the swell of the developer held up by the discharge mixer 76 from being changed according to the rotation of the blade 77. As a result, it is possible to suppress an amount of the excess developer, which is discharged from the discharge port 53 in order to replace the deteriorated carrier with the new carrier little by little, from fluctuating. Therefore, even when toner density is detected by making use of the holdup of the developer 51 by the discharge mixer 76, stabilization of an amount of the developer in the case 50 can be realized and improvement of an image quality by a satisfactory development characteristic can be obtained.

A second embodiment of the present invention is explained below. In the second embodiment, a plurality of the reducing plates according to the first embodiment are used. Otherwise, the second embodiment is the same as the first embodiment. Therefore, components same as those explained in the first embodiment are denoted by the same reference numerals and signs and detailed explanation of the components is omitted.

Figure 8:
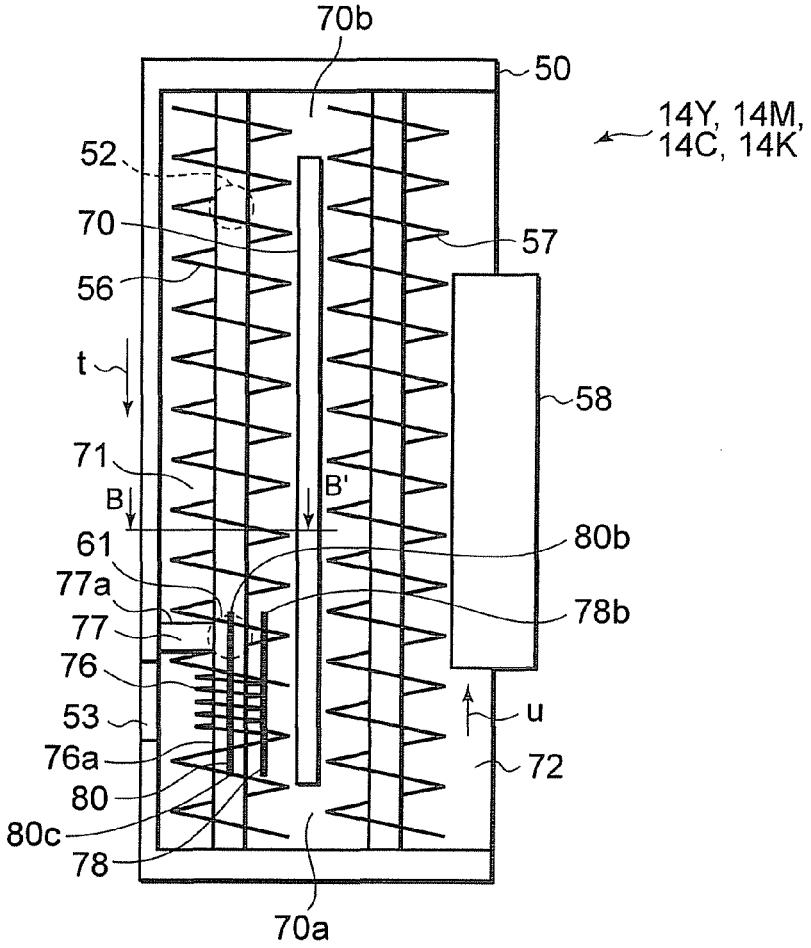
FIG. 8 is a schematic diagram for explaining a flow of a developer in a development container according to a second embodiment of the present invention.
Figure 9:
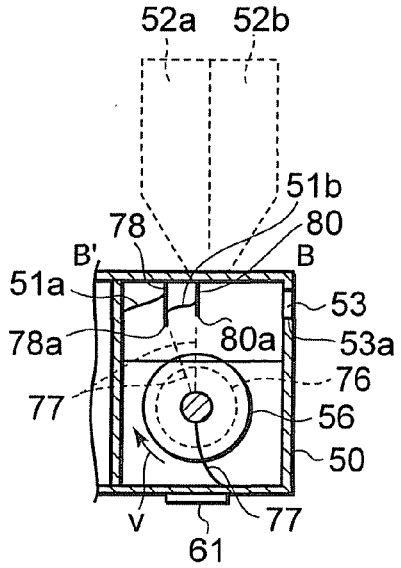
FIG. 9 is a schematic diagram viewed from a B-B' side in FIG. 8 for explaining the dam-up of the developer by a plate according to the second embodiment.
Figure 10:
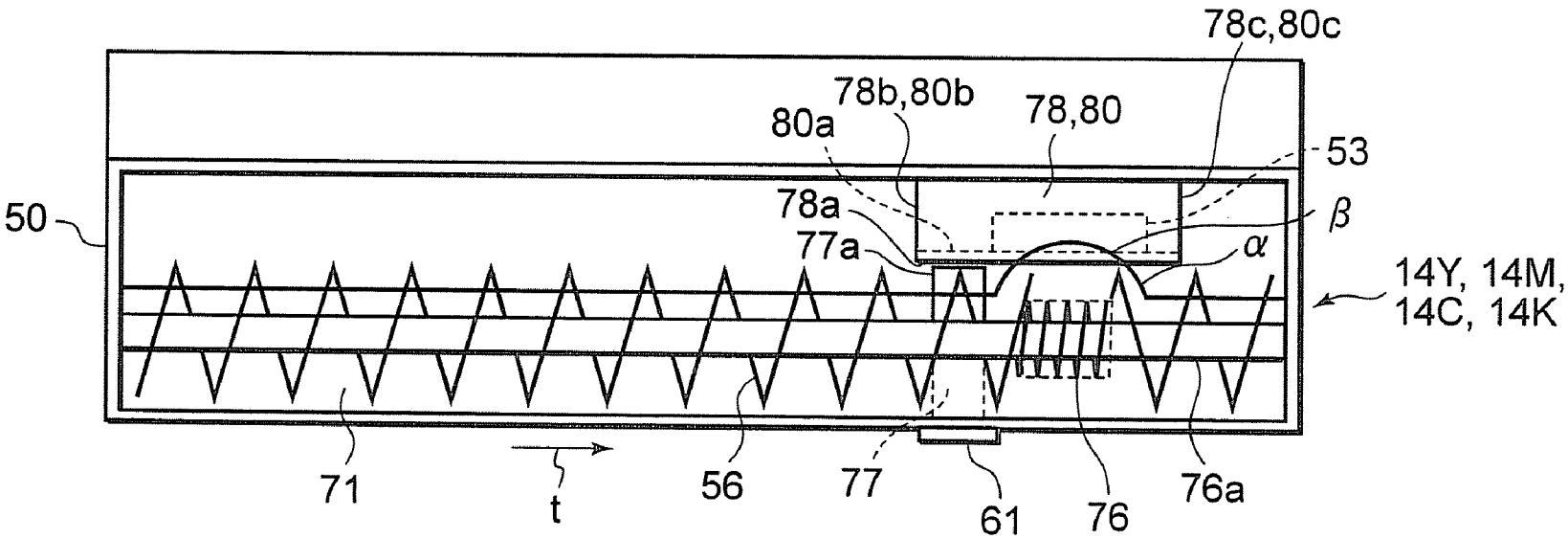
FIG. 10 is a schematic diagram for explaining the swell of the developer in the development container according to the second embodiment.

In this embodiment, as shown in FIGS. 8 to 10, the flat reducing plate 78 is provided on the opposite side of the discharge port 53 across the discharge mixer 76. Further, a flat auxiliary reducing plate 80 is provided in the center of the first agitation passage 71 (above the shaft 76*a* of the discharge mixer 76). The auxiliary reducing plate 80 is arranged in parallel to the reducing plate 78. The reducing plate 78 and the auxiliary reducing plate 80 are arranged in 2 lines in a direction orthogonal to the arrow "t" of the FIG. 8.

The size in the height direction of the auxiliary reducing plate 80 is formed smaller than that of the reducing plate 78. A lower end 80*a* of the auxiliary reducing plate 80 is located above the lower end 78*a* of the reducing plate 78 and is substantially the same position as the lower end 53*a* of the discharge port 53. The lateral width of the auxiliary reducing plate 80 is formed in the same size as the lateral width of the reducing plate 78. A third side end 80*b* on the toner density sensor side of the auxiliary reducing plate 80 extends further to an upstream side of the arrow "t" than the upstream side end 77*a* of the blade 77. It is in the same manner as the first side end 78*b* of the reducing plate 78. A second side end 80*c* of the auxiliary reducing plate 80 extends further to a downstream side of the arrow "t" than the crossing position β of the discharge port 53 and the tip of the swell of the developer (a tip position of the developer discharged from the discharge port 53). It is in the same manner as the second side end 78*c* of the reducing plate 78. The size in the height direction of the auxiliary reducing plate 80 is smaller than that of the reducing plate 78. The size in the width direction of the auxiliary reducing plate 80 is the same as that of the reducing plate 78. Both the reducing plate 78 and the auxiliary reducing plate 80 are formed larger than the discharge port 53.

While the developer 51 is circulated and carried by the rotation of the first mixer 56 and the second mixer 57, the developer 51 is swelled by the discharge mixer 76 in a position opposed to the discharge port 53. The height of the swell of the developer 51 is affected by the blade 77 rotated above the toner density sensor 61.

However, as shown in FIG. 9, a part of the developer 51*a* scraped up by the blade 77 is dammed up by the reducing plate 78. The developer 51*b* not dammed up by the reducing plate 78 is dammed up by the auxiliary reducing plate 80. Even when the blade 77 is rotated upward, the height of the swell of the developer 51 is suppressed. An amount of the developer pushed out to the discharge port 53 side by the rotation force of the blade 77 is also suppressed. As a result, an amount of the excess developer discharged from the discharge port 53 is stabilized. In other words, fluctuation in an amount of the developer in the case 50 is suppressed and the feeding of the developer to the developing roller 58 is stabilized.

According to the second embodiment, a part of the developer scraped up by the blade 77 is dammed up by the reducing plate 78. Further, a part of the developer passing through the reducing plate 78 is dammed up by the auxiliary reducing plate 80. Consequently, fluctuation in the swell of the developer held up in the discharge mixer 76 is suppressed. Therefore, fluctuation in an amount of the excess developer discharged from the discharge port 53 can be suppressed. Even when toner density is detected by making use of holdup of the developer 51 by the discharge mixer 76, stabilization of an amount of the developer in the case 50 can be realized and improvement of an image quality by a satisfactory development characteristic can be obtained.

A third embodiment of the present invention is explained below. The third embodiment is different from the second embodiment in the sizes of a reducing plate and an auxiliary reducing plate. Otherwise, the third embodiment is the same as the second embodiment. Therefore, components same as those explained in the second embodiment are denoted by the same reference numerals and signs and detailed explanation of the components is omitted.

Figure 11:
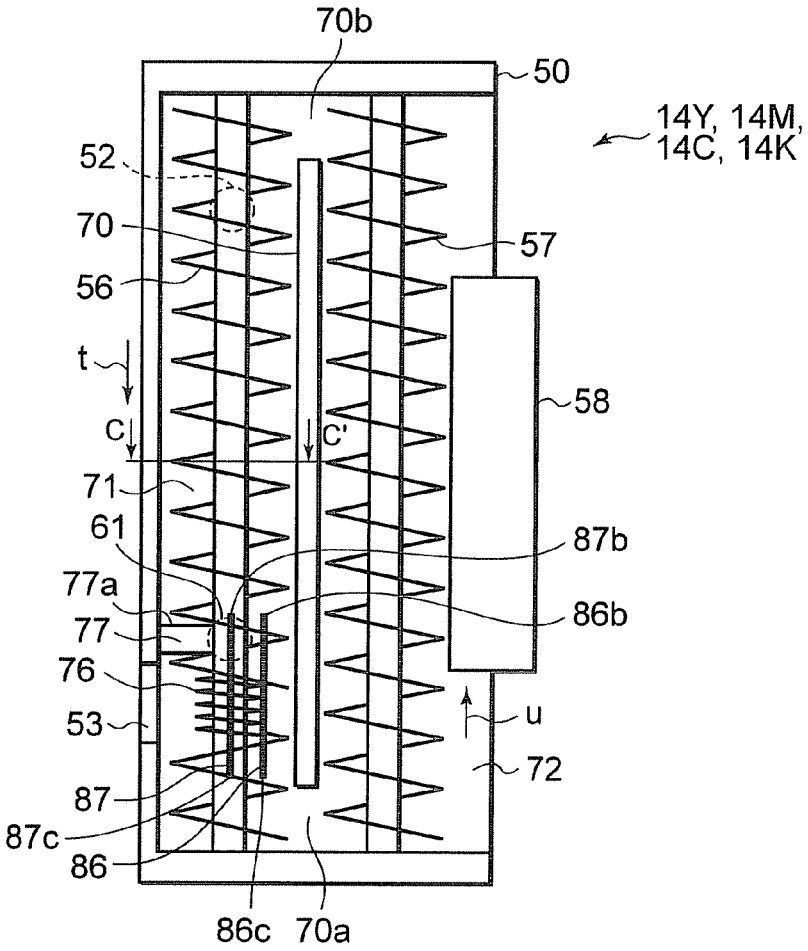
FIG. 11 is a schematic diagram for explaining a flow of a developer in a development container according to a third embodiment of the present invention.
Figure 12:
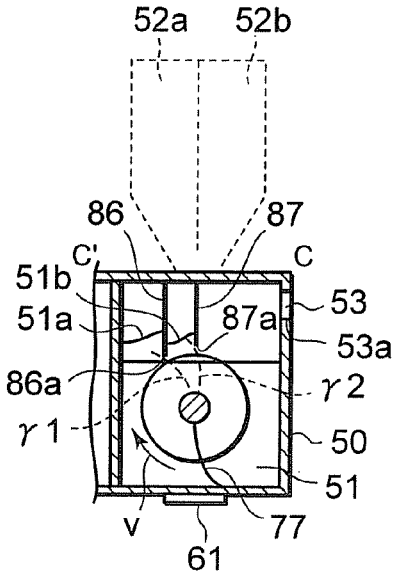
FIG. 12 is a schematic diagram viewed from a C-C' side in FIG. 11 for explaining the dam-up of the developer by a plate according to the third embodiment.
Figure 13:
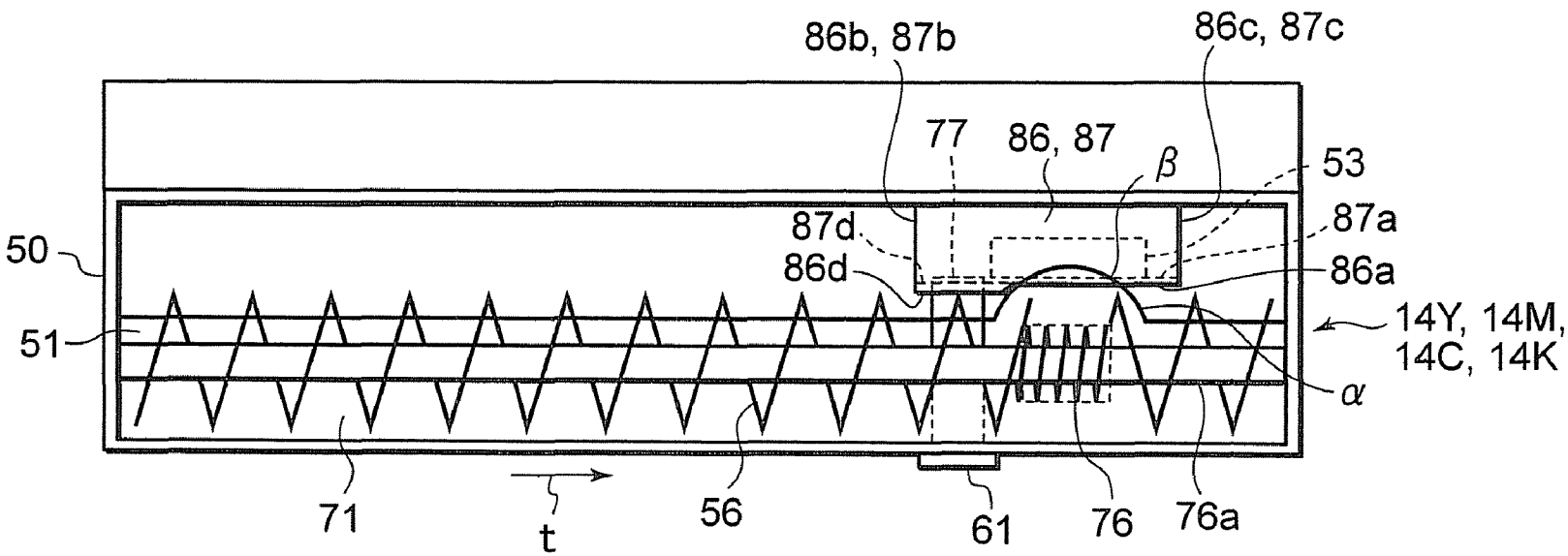
FIG. 13 is a schematic diagram for explaining the swell of the developer in the development container according to the third embodiment.

In this embodiment, as shown in FIGS. 11 to 13, a flat reducing plate 86 is provided on the opposite side of the discharge port 53 across the discharge mixer 76. Further, a flat auxiliary reducing plate 87 is provided in the center of the first agitation passage 71 (above the shaft 76*a* of the discharge mixer 76). The auxiliary reducing plate 87 is arranged in parallel to the reducing plate 86.

Both the reducing plate 86 and the auxiliary reducing plate 87 are formed to come into contact with the blade 77. A lower end 86*a* of the reducing plate 86 is formed to be lower than the lower end 53*a* of the discharge port 53 as indicated by a solid line in FIG. 13. The reducing plate 86 has an opposed section 86*d* extended to below the lower end 86*a*. The opposed section 86*d* comes into contact with the blade 77. A lower end 87*a* of the auxiliary reducing plate 87 is formed at height substantially the same as that of the lower end 53*a* of the discharge port 53 as indicated by a dotted line in FIG. 13. The auxiliary reducing plate 87 has an opposed section 87*d* extended to below the lower end 87*a*. The opposed section 87*d* comes into contact with the blade 77.

The lateral widths of the reducing plate 86 and the auxiliary reducing plate 87 are formed in the same size. Side ends 86*b* and 87*b* on the toner density sensor 61 side of the reducing plate 86 and the auxiliary reducing plate 87 extend further to an upstream side of the arrow "t" than the upstream side end 77*a* of the blade 77. The other ends 86*c* and 87*c* of the reducing plate 86 and the auxiliary reducing plate 87 extend further to a downstream side of the arrow "t" than the crossing position β of the discharge port 53 and the tip of the swell of the developer (a tip position of the developer discharged from the discharge port 53). Both the sizes in the width direction of the reducing plate 86 and the auxiliary reducing plate 87 are formed larger than the discharge port 53. An opposed section may be provided in only one of the reducing plate 86 and the auxiliary reducing plate 87. The entire length of the lower end of the reducing plate 86 or the auxiliary reducing plate 87 may be extended rather than only the opposed section of the lower end is extended.

While the developer 51 is circulated and carried by the rotation of the first mixer 56 and the second mixer 57, the developer 51 is swelled by the discharge mixer 76 on the front surface of the discharge port 53. As shown in FIG. 12, a part of the developer 51*a* scraped up by the blade 77 is dammed up by the reducing plate 86. The developer 51*b* not dammed up by the reducing plate 86 is dammed up by the auxiliary reducing plate 87.

On the other hand, when the blade 77 is rotated upward, the blade 77 comes into contact with the opposed section 86*d* of the reducing plate 86 as indicated by a dotted line γ1 in FIG. 12. Thereafter, when the shaft 76*a* of the discharge mixer 76 is further rotated, the blade 77 bends and then comes off the contact with the opposed section 86*d* of the reducing plate 86. The blade 77 coming off the reducing plate 86 comes into contact with the opposed section 87*d* of the auxiliary reducing plate 87 as indicated by a dotted line γ2 in FIG. 12. When the shaft 76*a* of the discharge mixer 76 is further rotated, the blade 77 bends and then comes off the contact with the opposed section 87*d* of the auxiliary reducing plate 87.

The blade 77 coming off the opposed section 87*d* of the auxiliary reducing plate 87 performs a function of pushing the developer 51 with the rotation force. At this point, the blade 77 passes the top and moves in the direction of the toner density sensor 61 below the blade 77. Therefore, the force of the blade 77 pushing the developer 51 is applied further to a lower side than the discharge port 53 and the developer is suppressed from being pushed out from the discharge port 53. As a result, an amount of the excess developer discharged from the discharge port 53 is stabilized. In other words, fluctuation in an amount of the developer in the case 50 is suppressed and the feeding of the developer to the developing roller 58 is stabilized.

According to the third embodiment, as in the second embodiment, apart of the developer scraped up by the blade 77 is dammed up by the reducing plate 86 and the auxiliary reducing plate 87. Consequently, fluctuation in the swell of the developer held up in the discharge mixer 76 is suppressed. Further, the blade 77 is lowered in the first agitation passage 71 while the blade 77 is brought into contact with the opposed section 86*d* of the reducing plate 86 and the opposed section 87*d* of the auxiliary reducing plate 87. Consequently, the force of the blade 77 pushing out the developer 51 from the discharge port 53 is suppressed. Therefore, fluctuation in an amount of the excess developer discharged from the discharge port 53 can be suppressed. Moreover, in both the reducing plate 86 and the auxiliary reducing plate 87, only the opposed sections 86*d* and 87*d* coming into contact with the blade 77 are extended. Therefore, it is unlikely that the discharge of the excess developer, which should be discharged from the discharge port 53 by the discharge mixer 76, is prevented. Therefore, even when toner density is detected by making use of the holdup of the developer 51 by the discharge mixer 76, stabilization of an amount of the developer in the case 50 can be realized and improvement of an image quality by a satisfactory development characteristic can be obtained.

The present invention is not limited to the embodiment. The embodiment can be variously modified without departing from the spirit of the present invention. For example, methods of supplying a toner and a carrier and amounts of supply of the toner and the carrier are not limited. The position and the size of the developer discharging section and the surface height of the developer by the swelling mechanism are not limited. Moreover, the size and the attaching position of the reducing member and the number of reducing members to be arranged are not limited.

What is claimed is:

1. A developing device comprising:

a development container that stores a developer including a toner and a carrier;

a developing member that feeds the developer in the development container to an image bearing member;

a developer supplying member that supplies the developer to the development container;

an agitating and carrying member that agitates the developer and carries the developer to a predetermined direction in the development container;

a developer discharging member that is formed in the development container and discharges a part of the developer;

a swelling member that swells a surface of the developer to discharges a part of the developer from the developer discharging member; and a plate member provided parallel to the predetermined direction in a position opposed to the developer discharging member and configured to dam the swelled developer and suppress a discharge of the developer from the developer discharging member.

2. The device according to claim 1, wherein a plurality of the plate members are arranged in a direction orthogonal to a circulating and carrying direction of the developer.

3. The device according to claim 2, wherein sizes of the plural plate members are different from one another.

4. The device according to claim 1, wherein the plate member has a flat plate parallel to a circulating and carrying direction of the developer, extends to below the discharge port in a vertical direction, and is larger than lateral width of the discharge port in a width direction.

5. The device according to claim 1, further comprising a toner-density detecting member that is arranged on an upstream side from the developer discharging member in a circulating and carrying direction of the developer and a sweeping-out member that sweeps a surface of the toner-density detecting member.

6. The device according to claim 5, wherein the swelling member is a rotational carrying member, carrying force for the developer of which is weaker than carrying force for the developer by the agitating and carrying member, and the sweeping-out member is attached to a shaft of the rotational carrying member and rotated.

7. The device according to claim 6, wherein a plurality of the plate members are arranged in a direction orthogonal to the circulating and carrying direction of the developer.

8. The device according to claim 7, wherein sizes of the plural plate members are different from one another.

9. The device according to claim 6, wherein the plate member has a flat plate parallel to the circulating and carrying direction, extends to below the discharge port in a vertical direction, and is larger than lateral width of the discharge port in a width direction.

10. The device according to claim 6, wherein the sweeping-out member has elasticity, and the plate member has a flat plate parallel to the circulating and carrying direction of the developer, extends to below the discharge port and comes into contact with the sweeping-out member in a vertical direction, and is larger than lateral width of the discharge port in a width direction.

11. An image forming apparatus comprising:

an image bearing member;

a latent-image forming member that forms an electrostatic latent image on the image bearing member;

a development container that stores a developer including a toner and a carrier;

a developing member that feeds the developer in the development container to an image bearing member;

a developer supplying member that supplies the developer to the development container;

an agitating and carrying member that agitates the developer and carries the developer to a predetermined direction in the development container;

a developer discharging member that is formed in the development container and discharges a part of the developer;

a swelling member that swells a surface of the developer to discharges a part of the developer from the developer discharging member; and a plate member provided parallel to the predetermined direction in a position opposed to the developer discharging member and configured to dam the swelled developer and suppress a discharge of the developer from the developer discharging member.

12. The apparatus according to claim 11, further comprising a toner-density detecting member that is arranged on an upstream side from the developer discharging member in a circulating and carrying direction of the developer and a sweeping-out member that sweeps a surface of the toner-density detecting member.

13. The apparatus according to claim 12, wherein the swelling member is a rotational carrying member, carrying force for the developer of which is weaker than carrying force for the developer by the agitating and carrying member, and the sweeping-out member is attached to a shaft of the rotational carrying member and rotated.

14. The apparatus according to claim 13, wherein a plurality of the plate members are arranged in a direction orthogonal to the circulating and carrying direction of the developer.

15. The apparatus according to claim 14, wherein sizes of the plural plate members are different from one another.

16. The apparatus according to claim 13, wherein the plate member has a flat plate parallel to the circulating and carrying direction of the developer, extends to below the discharge port in a vertical direction, and is larger than lateral width of the discharge port in a width direction.

17. The apparatus according to claim 13, wherein the sweeping-out member has elasticity, and the plate member has a flat plate parallel to the circulating and carrying direction of the developer, extends to below the discharge port and comes into contact with the sweeping-out member in a vertical direction, and is larger than lateral width of the discharge port in a width direction.

18. A developing method comprising:

feeding a developer including a toner and a carrier, which is circulated and carried in a development container, to an image bearing member;

supplying the developer to the development container;

swelling a surface of the developer high in a position opposed to a developer discharging member formed in the development container;

damming the swelled developer; and discharging a part of the developer from the developer discharging member.

19. The method according to claim 18, wherein a sweeping-out member is rotated to sweep a surface of a toner-density detecting member on an upstream side from the developer discharging member in a circulating and carrying direction of the developer, and damming up the swelled developer is performed by damming up carrying of the developer by the rotation of the sweeping-out member.

20. The method according to claim 19, wherein the damming-up of the carrying of the developer by the rotation of the sweeping-out member is performed plural times.

* * * * *